US010706981B2

(12) United States Patent
Tran

(10) Patent No.: US 10,706,981 B2
(45) Date of Patent: Jul. 7, 2020

(54) METHOD FOR DECONTAMINATING RADIOCONTAMINATED GRAINS

(71) Applicant: CORELEX SAN-EI CO., LTD., Fujinomiya-shi, Shizuoka (JP)

(72) Inventor: Ai Van Tran, Fujinomiya (JP)

(73) Assignee: CORELEX SAN-EI CO., LTD., Fujinomiya-shi, Shizuoka (JP)

( * ) Notice: Subject to any disclaimer, the term of this patent is extended or adjusted under 35 U.S.C. 154(b) by 53 days.

(21) Appl. No.: 15/775,876

(22) PCT Filed: Nov. 30, 2016

(86) PCT No.: PCT/JP2016/005030
§ 371 (c)(1),
(2) Date: May 14, 2018

(87) PCT Pub. No.: WO2017/122244
PCT Pub. Date: Jul. 20, 2017

(65) Prior Publication Data

US 2018/0330838 A1 Nov. 15, 2018

(30) Foreign Application Priority Data

Jan. 15, 2016 (JP) ..... 2016-005753

(51) Int. Cl.

| | |
|---|---|
| ***G21F 9/20*** | (2006.01) |
| ***G21F 9/30*** | (2006.01) |
| ***G21F 9/12*** | (2006.01) |
| ***G21F 9/28*** | (2006.01) |

(52) U.S. Cl.
CPC ..... *G21F 9/302* (2013.01); *G21F 9/12* (2013.01); *G21F 9/28* (2013.01)

(58) Field of Classification Search
CPC ..... G21F 9/30; G21F 9/302
USPC ..... 588/10
See application file for complete search history.

(56) References Cited

U.S. PATENT DOCUMENTS

| | | | |
|---|---|---|---|
| 5,436,384 | A | 7/1995 | Grant et al. |
| 6,204,430 | B1 | 3/2001 | Baldwin et al. |
| 2016/0222291 | A1 | 8/2016 | Sugano et al. |

FOREIGN PATENT DOCUMENTS

| | | | |
|---|---|---|---|
| JP | 7-185513 | A | 7/1995 |
| JP | 8-506524 | A | 7/1996 |
| JP | 2000-284092 | A | 10/2000 |
| JP | 2002-6087 | A | 1/2002 |
| JP | 2003-505226 | A | 2/2003 |
| JP | 2012-237658 | A | 12/2012 |
| JP | 2013-19876 | A | 1/2013 |
| JP | 2013-068459 | A | 4/2013 |
| JP | 2013-117449 | A | 6/2013 |
| JP | 2013-178132 | A | 9/2013 |
| JP | 2013-208592 | A | 10/2013 |
| JP | 2013-253952 | A | 12/2013 |
| JP | 2014-32110 | A | 2/2014 |
| JP | 2014-153153 | A | 8/2014 |
| JP | 2016-20884 | A | 2/2016 |
| WO | 95/15566 | A1 | 6/1995 |
| WO | 01/06517 | A1 | 1/2001 |
| WO | 2015/064522 | A1 | 5/2015 |

OTHER PUBLICATIONS

Tran et al., "Survey on decontamination of the soil contaminated with radioactive substances using porous/granular calcined material made from paper sludge," Dai 3 Kai Kankyo Hoshana Josen Kenkyu Happyokai Yoshishu, Jul. 3, 2014, p. 107 (5 pgs. total including translation).

International Search Report for PCT/JP2016/005030 dated Jan. 10, 2017 (PCT/ISA/210).

Extended European Search Report dated Aug. 12, 2019 issued by the European Patent Office in counterpart application No. 16884848.9.

*Primary Examiner* — Edward M Johnson
(74) *Attorney, Agent, or Firm* — Sughrue Mion, PLLC

(57) ABSTRACT

A method includes: a pre-treatment step of mixing radiocontaminated grains and a sodium phosphate-based dispersant; and a decontamination step of mixing the radiocontaminated grains processed by the pre-treatment step and paper sludge-derived sintered carbonized porous grains so as to incorporate radioactive $^{134}Cs$ and $^{137}Cs$ of the radiocontaminated grains in the sintered carbonized porous grains.

13 Claims, 3 Drawing Sheets

METHOD FOR DECONTAMINATING RADIOCONTAMINATED GRAINS

CROSS REFERENCE TO RELATED APPLICATIONS

This application is a National Stage of International Application No. PCT/JP2016/005030 filed Nov. 30, 2016, claiming priority based on Japanese Patent Application No. 2016-005753, filed Jan. 15, 2016.

TECHNICAL FIELD

The present invention relates to a method for decontaminating radiocontaminated grains which are contaminated by radioactive substances, and in particular, the present invention relates to a method for decontaminating radiocontaminated grains, the method including a pre-treatment step in which a decontamination degree of radioactive $^{134}Cs$ and $^{137}Cs$ is improved by paper sludge-derived sintered carbonized porous grains.

The radiocontaminated grains include sludge, rock particles, sediment, and dredging, which are deposited or discharged in treatment facilities of soil, drainage, sewage, and the like built in agricultural lands, private residential areas, public facilities, and the like. In addition, radioactive substances are elements including the lanthanoid elements with atomic numbers of 57 through 71 and cesium, each of which belong to Category 1, and elements including the actinoid elements with atomic numbers of 89 through 104 which belong to Category 2. In the present invention, cesium which belongs to Category 1 will be discussed.

BACKGROUND ART

A general decontamination treatment for radioactive cesium contaminated grains and, in particular, for soils is performed by two methods. A first method is a method primarily performed by a mechanical treatment. In a contaminated soil, a soil having a small grain diameter in which a most part of radioactive cesium is contained and a soil having a large grain diameter in which a small part of radioactive cesium is contained are classified (Patent Literature 1), or as a first step, a radioactive cesium contaminated soil is combusted in a combustion furnace, and a volume-reduced contaminated soil is then classified into a portion containing a large amount of radioactive cesium and a portion containing a small amount of radioactive cesium by a classification device (Patent Literature 2).

A second method is a method in which radioactive cesium is extracted from a radioactive cesium contaminated soil using a chemical agent solution. Extraction chemical agent solutions described in Patent Literature 3 are iron salts, such as ferrous chloride, ferric chloride, ferrous sulfate, ferric sulfate, ferrous nitrate, ferric nitrate, and polyferric sulfate, and chloride compounds, such as an ammonium salt and a potassium salt. This extraction liquid is further treated by cesium chloride, glycerin, or ethylene glycol monoethyl ether (EGME: cellosolve).

On the other hand, extraction chemical agent solutions described in Patent Literature 4 are an inorganic acid, an organic acid, and the like, this acidic solution is neutralized by an alkali agent and is further ion-exchanged in a washing step using washing water which contains ammonium sulfate, and a supernatant is separated from a deposited soil. This supernatant is processed so that radioactive substances are absorbed by an absorbent, such as mordenite or zeolite.

In the category 2 radioactive actinoid elements, such as uranium and plutonium, extraction chemical agent solutions according to Patent Literature 5 are sodium carbonate, oxalic acid, succinic acid, and EDTA (ethylenediaminetetraacetic acid functioning as a chelating agent), and in addition, when a sodium salt of the above extraction chemical agent is changed to a potassium salt thereof, the extraction efficiency is improved. Unlike the case of cesium, since uranium, plutonium, and the like are not likely to be dissolved in water, an oxidant, such as hydrogen peroxide, ozone, or potassium permanganate, is required to be added to the extraction chemical agent solution mentioned above.

The present inventor confirmed that after an improvement/purification test is performed on a radiocontaminated soil using paper sludge-derived sintered carbonized porous grains, radioactive $^{134}Cs$ and $^{137}Cs$ can be removed from the radiocontaminated soil, and the present inventor also disclosed in Patent Literature 6 that 30 Bq/kg, which is the total value of radioactive $^{134}Cs$ and $^{137}Cs$ contained in obtained white rice, is smaller than a Japanese reference value of 100 Bq/Kg.

In this case, the paper sludge-derived sintered carbonized porous grains are formed by sintering/carbonizing paper sludge discharged from paper manufacturing mills which use either waste paper or wood chip or both waste paper and wood chip, and have the following configuration.

(1) Paper sludge discharged from paper manufacturing mills which use either waste paper or wood chip or both waste paper and wood chip is processed by sintering/carbonization to form paper sludge-derived sintered carbonized porous grains which have a pH of not less than 8 and preferably not less than 10; an alkalinity equivalent value of 1.0 to 4.0 meq/g (as NaOH) and preferably 1.5 to 2.5 meq/g (as NaOH); a cation exchange capacity of 1.0 to 4.0 meq/100 g (as $NH_4$) and preferably 1.5 to 3.0 meq/100 g (as $NH_4$); an electric conductivity of 70 to 150 μS/cm; a sodium (Na) content of not less than 0.0003%; a potassium (K) content of not less than 0.0003%; an organic content of less than 25%; and an inorganic content of not less than 75%, and the paper sludge-derived sintered carbonized porous grains thus obtained are dispersed on or mixed with radiocontaminated soil to remove radioactive substances therefrom.

(2) In the manufacturing process of the said paper sludge-derived sintered carbonized porous grains, the impregnation of the paper sludge with either potassium iodide (KI) alone or ethylenediaminetetraacetic acid (EDTA) alone or a combination of KI and EDTA was not incorporated.

(3) The radiocontaminated soil contains radioactive $^{134}Cs$ and $^{137}Cs$ at a total dosage of not less than 800 Bq/kg.

(4) The dosage of the said paper sludge-derived sintered carbonized porous grains spread on or mixed with the radiocontaminated soil is 0.1 to 6 kg/m$^2$ (0.5 to 50 kg/m$^3$) (0.1 to 6 percent by weight of dry soil) and preferably 1.0 to 3.5 kg/m$^2$ (8 to 30 kg/m$^3$) (0.9 to 3.3 percent by weight of dry soil).

(5) The paper sludge has a moisture content of 50% to 85%, and after being pelletized and dried, this paper sludge is pyrolyzed in a reducing carbonization sintering furnace at a temperature of 500° C. to 1,300° C., preferably 700° C. to 1,200° C. Furthermore, carbonization is preferably carried out at 800° C. to 1,100° C.

(6) The said paper sludge-derived sintered carbonized porous grains contain, on oven-dry weight basis, 15% to 25% of combustibles (including carbon), 0.5% to 3.0% of $TiO_2$, 0.0001% to 0.0005% of $Na_2O$, 0.0001% to 0.0005% of $K_2O$, 15% to 35% of $SiO_2$, 8% to 20% of $Al_2O_3$, 5% to 15% of $Fe_2O_3$, 15% to 30% of CaO, 1% to 8% of MgO, and a balance of 0.5% to 3.0% (including impurities), the total of these being 100%; and has a water absorption rate of 100% to 160% in accordance with JIS C2141, a specific surface area of 80 to 150 $m^2/g$ in accordance with the BET adsorption method, and an interconnected cell structure.

(7) The said paper sludge-derived sintered carbonized porous grains are to have a porosity volume rate of not less than 70%, a porosity volume of not less than 1,000 $mm^3/g$, an average pore radius of 20 to 60 μm, and pores with radius of not less than 1 μm constitute not less than 70% of the total porosity volume, and are a mixture of various forms such as spherical, oval, or cylindrical or the like forms with each having an axis length of 1 to 10 mm, and a black color.

CITATION LIST

Patent Literature

PTL 1: Japanese Unexamined Patent Application Publication No. 2013-208592

PTL 2: Japanese Unexamined Patent Application Publication No. 2014-153153

PTL 3: Japanese Unexamined Patent Application Publication No. 2012-237658

PTL 4: Japanese Unexamined Patent Application Publication No. 2013-178132

PTL 5: Japanese Unexamined Patent Application Publication (Translation of PCT Application) No. 8-506524

PTL 6: Japanese Unexamined Patent Application Publication No. 2013-068459

SUMMARY OF INVENTION

Technical Problem

Since it was confirmed that radioactive $^{134}Cs$ and $^{137}Cs$ were removed for decontamination from a radiocontaminated soil by the above paper sludge-derived sintered carbonized porous grains (paper sludge carbon (hereinafter, also referred to as "PSC")), an influence test of radioactive substances on PSC was performed. As a result, since calcium, iron, magnesium, copper, potassium, barium, chlorine, sulfur, and the like of PSC were decreased, radioactive $^{134}Cs$ and $^{137}Cs$ in a radiocontaminated soil were estimated to be ion-exchanged with calcium, iron, magnesium, copper, potassium, and barium of PSC. In general, chlorine and sulfur are each not present by itself but is present as a metal salt compound by bonding to the above metal, such as calcium or iron.

In order to improve a decontamination degree of radioactive $^{134}Cs$ and $^{137}Cs$ by PSC, chloride compounds and sulfur compounds of calcium, iron, magnesium, copper, potassium, and barium were impregnated in PSC. As a result, although the decontamination degree of radioactive $^{134}Cs$ and $^{137}Cs$ was 23.0% by PSC which is not impregnated with the above compounds, the decontamination degrees were 42.1%, 35.9%, and 36.1% by PSC impregnated with 5% potassium chloride, PSC impregnated with 1% magnesium sulfate, and PSC impregnated with 1% copper sulfate, respectively.

Solution to Problem

The present invention provides a method for further increasing a decontamination degree of radioactive $^{134}Cs$ and $^{137}Cs$ of radiocontaminated grains, the decontamination degree being improved by using PSC in which potassium chloride, magnesium sulfate, and/or copper sulfate is impregnated.

Solution to Problem

In order to achieve the object described above, a method for decontaminating radiocontaminated grains according to the present invention comprises: a pre-treatment step of mixing radiocontaminated grains and a sodium phosphate-based dispersant; and a decontamination step of mixing the radiocontaminated grains processed by the above pre-treatment step and paper sludge-derived sintered carbonized porous grains so as to incorporate radioactive $^{134}Cs$ and $^{137}Cs$ of the radiocontaminated grains in the sintered carbonized porous grains.

In the decontamination method of radiocontaminated grains according to the present invention, the sodium phosphate-based dispersant contains at least one compound selected from the group consisting of sodium hexametaphosphate, sodium tripolyphosphate, and sodium tetrapyrophosphate.

In the decontamination method of radiocontaminated grains according to the present invention, at least one compound selected from the group consisting of potassium chloride, magnesium sulfate, and copper sulfate, each of which is ion-exchangeable, is impregnated in the sintered carbonized porous grains, and this sintered carbonized porous grains and the radiocontaminated grains processed by the above pre-treatment step are mixed with each other, so that the radioactive $^{134}Cs$ and $^{137}Cs$ of the radiocontaminated grains are incorporated in the sintered carbonized porous grains by ion-exchange.

Advantageous Effects of Invention

In the decontamination method of radiocontaminated grains according to the present invention, since the pre-treatment step of mixing radiocontaminated grains and a sodium phosphate-based dispersant is performed, the structure of the radiocontaminated grains is loosened by the sodium-based dispersant, and the internal space of the grain is increased. Hence, when the radiocontaminated grains are mixed with the paper sludge-derived sintered carbonized porous grains, the radioactive $^{134}Cs$ and $^{137}Cs$ are likely to be incorporated in the sintered carbonized porous grains. As a result, compared to the case in which the pre-treatment step is not performed, the decontamination rate can be improved.

In addition, the decontamination method of radiocontaminated grains according to the present invention comprehensively satisfies requirements in terms of cost and usefulness and can significantly increase the decontamination degree of the radioactive $^{134}Cs$ and $^{137}Cs$, and in the case of soil, the soil can be recycled for production of rice, food, vegetables, and the like. Furthermore, from rice, food, vegetables, and the like harvested from the soil described above, no radioactive $^{134}Cs$ and $^{137}Cs$ are detected, or the value thereof can be easily decreased lower than the Japanese reference value, so that safe and secure for health can be advantageously obtained.

In addition, in the decontamination method of radiocontaminated grains according to the present invention, the sintered carbonized porous grains are impregnated with at least one compound selected from the group consisting of potassium chloride, magnesium sulfate, and copper sulfate, each of which is ion-exchangeable. In addition, by the pre-treatment step, the structure of the radiocontaminated grains is loosened, and the internal space thereof is increased. Hence, when the radiocontaminated grains are mixed with the sintered carbonized porous grains, the radioactive $^{134}Cs$ and $^{137}Cs$ are likely to be ion-exchanged, and compared to the case in which the pre-treatment step is not performed, the decontamination rate can be improved.

In addition, in the decontamination method of radiocontaminated grains according to the present invention, sodium hexametaphosphate, sodium tripolyphosphate, and/or sodium tetrapyrophosphate can be used as the sodium phosphate-based dispersant to be used in the pre-treatment step.

DESCRIPTION OF EMBODIMENTS

Figure 1:
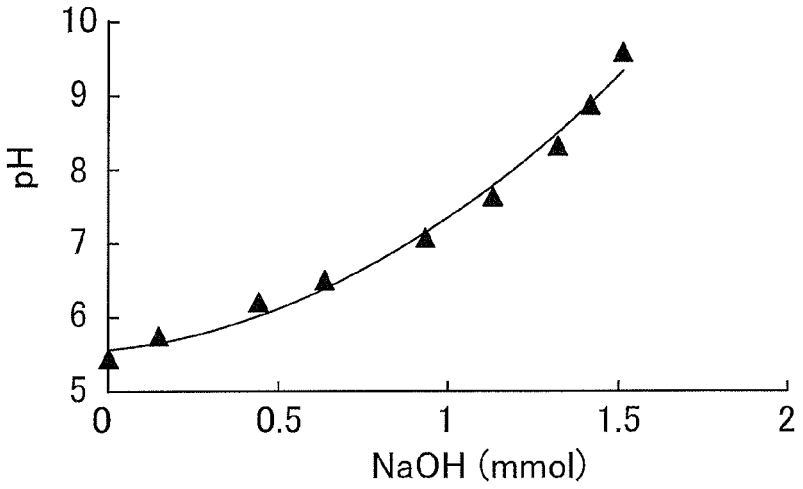
FIG. 1 is a graph showing the change in pH of sodium hexametaphosphate which functions as a dispersant to be used in a pre-treatment step of a decontamination method of radiocontaminated grains according to an embodiment of the present invention.

Hereinafter, a decontamination method of radiocontaminated grains according to an embodiment of the present invention will be described. However, the present invention is not limited to the following description.

As described above, ion exchangeable metal salts, that is, 5% KCl (percentage to PSC weight), 1% $MgSO_4$ (percentage to PSC weight), and 1% $CuSO_4$ (percentage to PSC weight), were each impregnated in sintered carbonized porous grains (PSC). Hereinafter, the PSC impregnated with each metal compound is referred to as "metal name-PSC (for example, 5% KCl-PSC). When those 5% KCl-PSC, 1% $MgSO_4$-PSC, and 1% $CuSO_4$-PSC were each mixed with radiocontaminated grains, an ion-exchange property with radioactive $^{134}Cs$ and $^{137}Cs$ of the radiocontaminated grains is improved, and a decontamination rate is also improved. Compared to a decontamination rate of 23.0% of PSC itself, the decontamination rates of 5% KCl-PSC, 1% $MgSO_4$-PSC and 1% $CuSO_4$-PSC were 42.1%, 35.9%, and 36.1%, respectively, and were significantly improved.

The decontamination method of radiocontaminated grains according to the embodiment of the present invention comprises: a pre-treatment step of mixing radiocontaminated grains and a sodium phosphate-based dispersant; and a decontamination step of mixing the radiocontaminated grains processed by the above pre-treatment step and paper sludge-derived sintered carbonized porous grains impregnated with at least one compound selected from the group consisting of potassium chloride, magnesium sulfate, and copper sulfate so as to incorporate radioactive $^{134}Cs$ and $^{137}Cs$ of the radiocontaminated grains in the sintered carbonized porous grains.

In this decontamination method of radiocontaminated grains, before the sintered carbonized porous grains impregnated with potassium chloride, magnesium sulfate, and/or copper sulfate is used, the pre-treatment step of mixing the dispersant and the radiocontaminated grains is performed, so that components of the grains are sufficiently dispersed or a portion between a non-expanded layer and an expanded layer of clay of the grains is swelled. As on example, in the case of soil, after the dispersant is spread over the soil and well mixed therewith so that clay is sufficiently separated from sand, silt, and the like and, furthermore, so that a portion between a non-expanded layer and an expanded layer of the clay is swelled, the sintered carbonized porous grains impregnated with potassium chloride, magnesium sulfate, and/or copper sulfate are again spread over the soil and well mixed therewith, so that the ion-exchange property with the radioactive $^{134}Cs$ and $^{137}Cs$ of the radiocontaminated soil is further improved.

According to the following technical literature, radioactive $^{137}Cs$ has a property of preferentially adsorbing to a radiocontaminated soil containing micaceous minerals (Francis, C. W., Brinkley, F. S., 1976. Preferential Adsorption of $^{137}Cs$ to micaceous minerals in contaminated fresh water sediment. Nature 260, 511-513). Furthermore, in the radiocontaminated soil containing micaceous minerals described above, radioactive $^{134}Cs$ and $^{137}Cs$ having a concentration of $2.27\times10^{-10}$ $mole_{cs}/kg_{soil}$ is contained, and in other words, not less than 60% of the total of the radioactive $^{134}Cs$ and $^{137}Cs$ of the radiocontaminated soil can be removed for decontamination (Kozai, N., Ohnuki, T., Arisaka, M., Watanabe, M., Sakamoto, F., Yamasaki, S., Jiang, M-y., 2012. Chemical states of fallout radioactive Cs in the soils deposited at Fukushima Daiichi Nuclear Power Plant accident. J. Nucl. Sci. Technol. 49, 473-478). That is, approximately 40% of the total of the radioactive $^{134}Cs$ and $^{137}Cs$ can be ion-exchangeable. This result is approximately the same as that of the decontamination rate of each of 5% KCl-PSC, 1% $MgSO_4$-PSC, and 1% $CuSO_4$-PSC.

Between a non-expanded layer (1.0 nm) and an expanded layer (1.4 nm) of the clay having micaceous minerals, a void surrounded by negative charges (derived from oxygen) is present, and radioactive cesium is adsorbed in those voids. In particular, to a frayed edge site which is a V-shaped intermediate zone between the above layers, radioactive cesium is selectively adsorbed (Nakao, A., Thiry, Y., Funakawa, S. Y., Kosaki, T., 2008. Characterization of the frayed edge site of micaceous minerals in soil clays influenced by different pedogenetic conditions in Japan and northern Thailand. Soil Sci. Plant Nutri. 54, 479-489). Hence, radioactive cesium is more strongly bonded to soil. Since a Japanese soil is acidic, the frayed edge site is easily folded, and the amount of negative charges is also decreased.

There has been an assumed mechanism in which radioactive cesium is adsorbed to a clay having micaceous minerals by two steps. In a first step, a diffusion reaction of radioactive cesium is rapidly performed, and a reaction site is between the non-expanded layer and the expanded layer. In a second step, the diffusion reaction of radioactive cesium is slow, and the reaction site is a folded frayed edge site (Comans, R. N., Haller, M., De Preter, P., 1991. Sorption of cesium on illite: Non-equilibrium behaviour and reversibility. Geochim. Cosmochim. Acta 55, 433-440). Nowadays, the diffusion reaction of cesium at the frayed edge site is experimentally confirmed (Man, C. K., Chu, P. Y., 2004. Experimental and modelling studies of radiocesium retention in soils. J Radioanal Nucl Chem 262: 339-344). Furthermore, the rate of the diffusion reaction at the frayed edge site is calculated as $0.009\ \exp(-4\times10^{-5}\cdot t(s^{-1})$, and in addition, the unit of the reaction time t is second (Ohnuki, T., 1994. Sorption characteristics of cesium on sandy soils and their components. Radiochim. Acta 65, 75-80).

According to the following recent technical literature, since radioactive cesium reacts at an early stage with calcium hydroxide at the frayed edge site of clay, and the frayed edge site is folded thereby, cesium at the frayed edge site is not allowed to react with calcium, so that the cesium cannot be removed. The cesium moves with time to a deeper side between the non-expanded layer and the expanded layer and then fixed while being ion-exchanged with potassium present at the deeper side (Fuller, A. J., Shaw, S., Ward, M. B., Haigh, S. J., Mosselmans J. F. W., Peacock, C. L., Stackhouse, S., Dent, A. J., Trivedi, D., Burke, I. T., 2015. Caesium incorporation and retention in illite interlayers. Appl. Clay Sci. 108, 128-134).

According to the above technical literatures, it is believed that cesium which could not be removed can be removed for decontamination when the frayed edge site and the portion between the non-expanded layer and the expanded layer are decomposed or cleaved. In the case described above, in the decontamination method of radiocontaminated grains according to the embodiment of the present invention, the pre-treatment step of mixing radiocontaminated grains and a dispersant is first performed, so that the frayed edge site and the portion between the non-expanded layer and the expanded layer are sufficiently expanded. Subsequently, since 5% KCl-PSC, 1% $MgSO_4$-PSC, and/or 1% $CuSO_4$-PSC is charged and then well mixed together, cesium which cannot be removed is promoted to perform an ion-exchange reaction with potassium, magnesium, copper, and/or the like impregnated in PSC. Hence, the decontamination rate of the radioactive $^{134}Cs$ and $^{137}Cs$ of the radiocontaminated grains is significantly increased.

The decontamination method of radiocontaminated grains according to the embodiment of the present invention uses in the pre-treatment step, as the phosphate-based dispersant, sodium hexametaphosphate (SHMP), sodium tripolyphosphate (STPP), and/or sodium tetrapyrophosphate (TSPP).

As shown in FIG. 1, sodium hexametaphosphate (SHMP) is a weak acid which is easily neutralized with sodium hydroxide.

Figure 2:
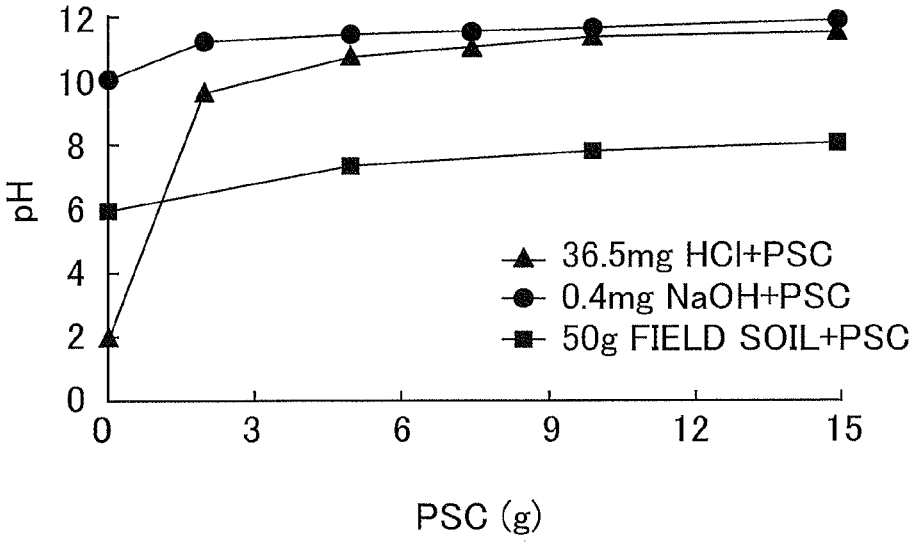
FIG. 2 is a graph showing the influence of sintered carbonized porous grains (PSC) to be used for the decontamination method of radiocontaminated grains according to the embodiment of the present invention on pH of each of hydrochloric acid, sodium hydroxide, and a field soil.

With 10 g of paper sludge-derived sintered carbonized porous grains (PSC), pHs of 1 mmol of hydrochloric acid and 0.01 mmol of sodium hydroxide were each increased to 11.3, and a pH of a field soil was increased from 5.9 to 7.6. The results are shown in FIG. 2. It is understood that when the results shown in FIGS. 1 and 2 are collectively taken into consideration, the pH of a mixture of sodium hexametaphosphate and a soil can be easily neutralized with PSC.

Next, although examples of the present invention will be described, the present invention is not limited to those examples at all.

A radiocontaminated soil in Iitate village, Fukushima prefecture was sampled in April, 2014 and was used for an influence test of dispersants. The radiocontaminated soil was air-dried to a solid component of not less than 90%, and in an experiment, the solid component was adjusted to approximately 80% with distilled water. This radiocontaminated soil was used for examples and reference examples. In addition, because of the nuclear power plant accident by the Great East Japan Earthquake on Mar. 11, 2011, radioactive substances were detected from some soils.

Reference Example 1

After the radiocontaminated soil (80 g, oven dried (OD) weight) and 5% KCl-PSC (20 g, OD weight) were charged in a polyethylene bag in this order, were then well mixed together, and were finally left at 25° C. for 10 days, radioactive $^{134}Cs$ and $^{137}Cs$ were measured. The radioactive $^{134}Cs$ and $^{137}Cs$ of the radiocontaminated soil were measured using a coaxial type germanium detector manufactured by Canberra in accordance with "Radiation Measurement Manual of Food in an Emergency," published by Ministry of Health, Labour and Welfare and "γ-rays Spectrometry by Germanium Semiconductor Detector" published by Ministry of Education, Culture, Sports, Science and Technology.

Figure 3:
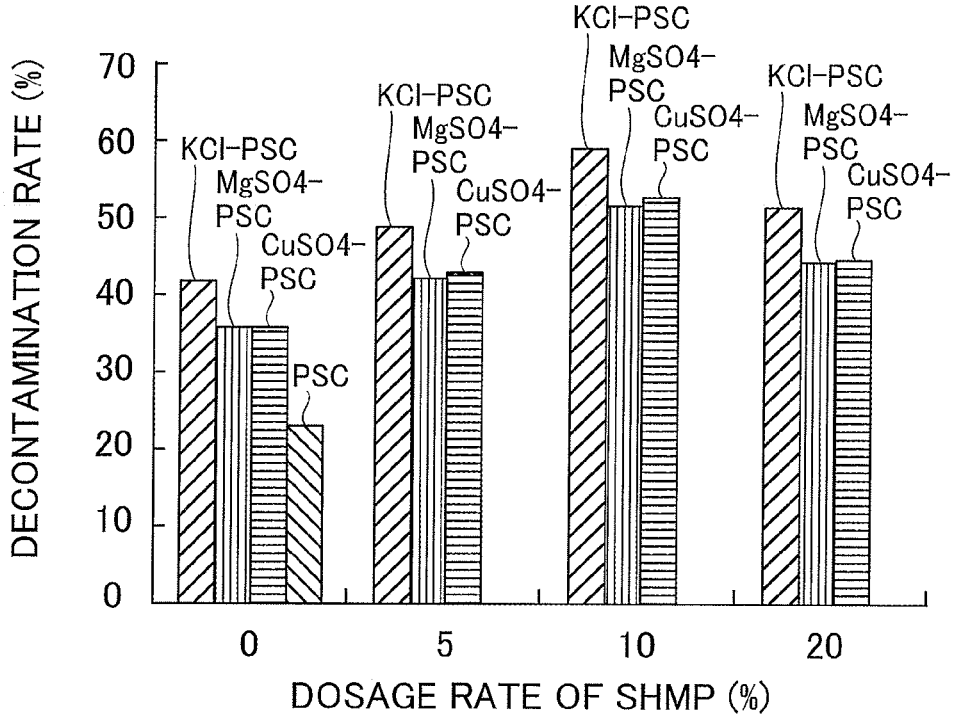
FIG. 3 is a graph showing the influence of a dosage rate of sodium hexametaphosphate on a decontamination degree of each of 5% KCl-PSC, 1% $MgSO_4$-PSC, and 1% $CuSO_4$-PSC by the decontamination method of radiocontaminated grains according to the embodiment of the present invention. The radiocontaminated grains are one example of a radiocontaminated soil.

Experiments using 1% $MgSO_4$-PSC and 1% $CuSO_4$-PSC were each performed by a procedure similar to that using 5% KCl-PSC. The results are shown in FIG. 3.

Example 1

After three types of sodium hexametaphosphate (SHMP), the concentrations of which were 5%, 10%, and 20% (percentage with respect to the soil weight), were each charged in a polyethylene bag together with the radiocontaminated soil (80 g, OD weight) and were well mixed together, the mixtures thus obtained were each left at 25° C. for 2 days. Subsequently, after 5% KCl—PSC, 1% $MgSO_4$—PSC, and 1% $CuSO_4$-PSC (each 20 g, OD weight) were added to the respective SHMP-level polyethylene bags, were then again well mixed together, and were finally left at 25° C. for 10 days, the radioactive $^{134}Cs$ and $^{137}Cs$ were measured. The results thus obtained are shown in FIG. 3.

The decontamination rates obtained by 5% KCl—PSC, 1% $MgSO_4$—PSC, and 1% $CuSO_4$—PSC were high, such as 42.1%, 35.9%, and 36.1%, respectively, each of which was not less than 1.6 times as compared to a decontamination rate of 23% obtained by PSC which was not impregnated with calcium chloride, magnesium sulfate, and/or copper sulfate. The reason for this is estimated that ion-exchange is promoted between each of potassium chloride, magnesium sulfate, and copper sulfate impregnated in PSC and the radioactive cesium. In addition, by the pre-treatment in which the radiocontaminated soil was mixed with sodium hexametaphosphate (SHMP), the decontamination rates of 5% KCl-PSC, 1% $MgSO_4$-PSCSC, and 1% $CuSO_4$-PSC were increased as compared to the decontamination rates of 5% KCl-PSC, 1% $MgSO_4$-PSC, and 1% $CuSO_4$-PSC obtained without performing the pre-treatment. When the dosage rate of SHMP is in a range of 5% to 20%, the highest decontamination rate was obtained by a pre-treatment performed at a dosage rate of 10%, and the decontamination rates of 5% KCl-PSC, 1% $MgSO_4$-PSC, and 1% $CuSO_4$-PSC were all increased by approximately 1.4 times.

In particular, the decontamination rate obtained by 5% KCl-PSC was highest, such as approximately 60%. From the results described above, it is believed that SHMP disperses clay, sand, silt, and the like of the soil, expands the portion between the non-expanded layer and the expanded layer, or decomposes/cleaves the portion therebetween.

Example 2

After the soil containing radiocontaminated grains was pre-treated using one of sodium hexametaphosphate (SHMP), sodium tripolyphosphate (STPP), and sodium tetrapyrophosphate (TSPP) each having a concentration of 10%, the soil thus pre-treated was mixed (decontaminated) with each of 5% KCl—PSC, 1% $MgSO_4$—PSC, and 1% $CuSO_4$—PSC, and the radioactive $^{134}Cs$ and $^{137}Cs$ were measured. The experiment method was performed in a manner similar to that of Example 1, and the results thus obtained are shown in FIG. 4.

Figure 4:
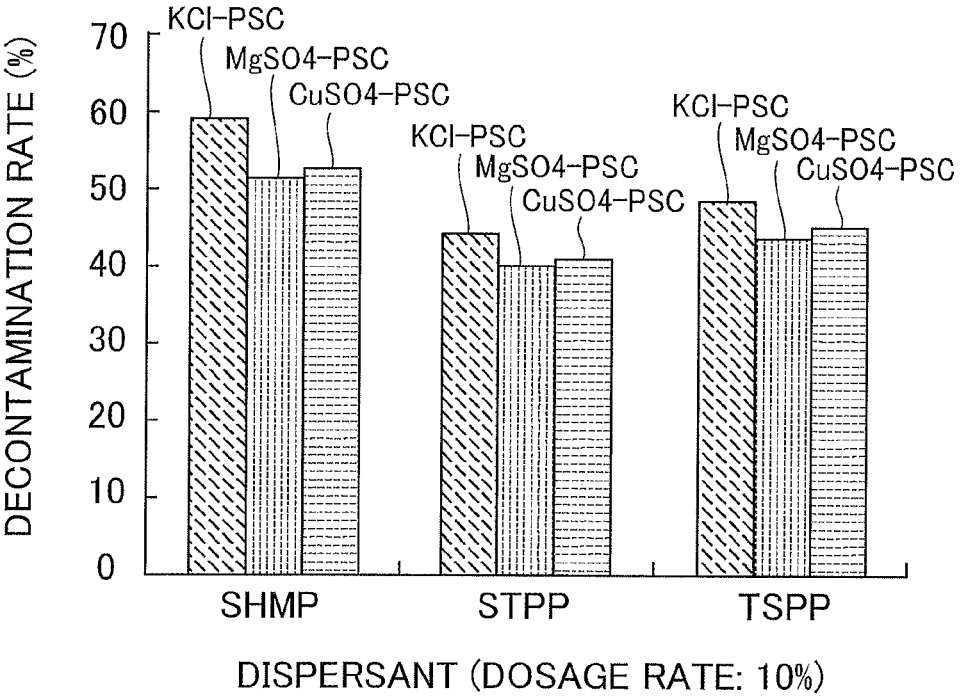
FIG. 4 is a graph showing the influence of a dispersant, that is, each of sodium hexametaphosphate, sodium tripolyphosphate, and sodium tetrapyrophosphate, on the decontamination degree of each of 5% KCl-PSC, 1% $MgSO_4$-PSC, and 1% $CuSO_4$-PSC by the decontamination method of radiocontaminated grains according to the embodiment of the present invention. The radiocontaminated grains are one example of a radiocontaminated soil.

As shown in FIG. 4, regardless whether 5% KCl-PSC, 1% $MgSO_4$—PSC, or 1% $CuSO_4$—PSC was used, the pre-treatment effect for the decontamination rate of sodium hexametaphosphate (SHMP) was superior to that of each of sodium tripolyphosphate (STPP) and sodium tetrapyrophosphate (TSPP). The dispersants having a superior decontamination treatment effect were ranked as SHMP>TSPP>STPP in this order. Accordingly, it was found that by all the sodium phosphate-based dispersants thus used, the decontamination performance of PSC was improved.

As described above, according to this embodiment, for decontamination of the radiocontaminated grains, after the radiocontaminated grains are first pre-treated using a dispersant selected from the group consisting of sodium hexametaphosphate (SHMP), sodium tripolyphosphate (STPP), and sodium tetrapyrophosphate (TSPP), a compound selected from the group consisting of potassium chloride, magnesium sulfate, and copper sulfate is impregnated in PSC, and decontamination is then performed, so that the decontamination rate is significantly improved as compared to that obtained without performing the pre-treatment.

Since the pre-treatment using a sodium phosphate-based dispersant can be easily operated, and a metal salt compound can be easily adjusted, can be easily impregnated in PSC, and is an inexpensive commercially available product, a technique which comprehensively satisfies the requirements in terms of cost and usefulness is obtained. Furthermore, radiocontaminated grains (soil) which are decontaminated for production of rice, food, vegetables, and the like can be recycled, and in addition, from rice, food, vegetables, and the like harvested from the soil described above, the radioactive $^{134}Cs$ and $^{137}Cs$ can be made undetectable, or the values thereof can be easily decreased lower than the Japanese reference value.

In consideration of the results shown in FIGS. 3 and 4, in order to improve the decontamination rate of the radiocontaminated grains, a chloride compound of potassium, a sulfate compound of magnesium, or a sulfate compound of copper should be impregnated in PSC. Furthermore, in order to obtain a synergetic effect of the decontamination rate of the radiocontaminated grains, not less than two compounds selected from available six combinations among a chloride of potassium, a sulfate of magnesium, and a sulfate of copper can be impregnated in PSC.

In addition, in order to obtain the synergetic effect of the decontamination rate of the radiocontaminated grains, as for the dispersant, by the use of a dispersant impregnated with not less than two compounds selected from available six combinations among sodium hexametaphosphate, sodium tripolyphosphate, and sodium tetrapyrophosphate, the pre-treatment should also be performed.

In addition, as the radiocontaminated grains, there may be mentioned sludge, rock particles, sediment, and dredging deposited or discharged in treatment facilities of soils, drainage, sewage, and the like built in agricultural lands, private residential areas, public facilities, and the like. In addition, the decontamination method of radiocontaminated grains according to this embodiment is not limited, for example, to the places described above and may also be applied, for example, to sludge, sediment, and the like deposited or discharged to a place in which the radiocontaminated grains can be contained.

In addition, even when the pre-treated radiocontaminated grains and PSC which is not impregnated with a metal salt, such as potassium chloride, are mixed together, the decontamination rate is improved. The reason for this is believed that when the radiocontaminated grains are pre-treated using a sodium salt-based dispersant, the structure of the radiocontaminated grains is loosened, and the internal space thereof is increased, so that when the radiocontaminated grains are mixed with PSC, the radioactive $^{134}Cs$ and $^{137}Cs$ are likely to be incorporated in PSC.

Next, examples of a useful metal-PSC other than the above 5% KCl—PSC, 1% $MgSO_4$—PSC, and 1% $CuSO_4$—PSC will be described. In mixing of PSC and the radiocontaminated soil, the influence of radioactive substances, such as the radioactive $^{134}Cs$ and $^{137}Cs$, contained in the radiocontaminated soil on PSC was investigated by a laboratory test. In this test, a radiocontaminated soil (100 g, OD) in Iitate village, Fukushima prefecture sampled in Summer, 2012 was charged in a polyethylene bag, and PSC (10 g, OD) received in a mesh bag was buried in the radiocontaminated soil and was left at 25° C. for 10 days. On the other hand, in a blank test, after the radiocontaminated soil (100 g, OD) and PSC (10 g, OD) were charged in a polyethylene bag and were then well mixed together, a test was performed under the same conditions as described above. The radioactive $^{134}Cs$ and $^{137}Cs$, pH, and an ion exchange capacity (CEC: cation exchange capacity) of each of the radiocontaminated soil and PSC, and the metal compositions of PSC before and after contamination were measured. The quality results of the radiocontaminated soil and PSC are shown in Table 1 and FIG. 5, and the metal compositions of PSC before and after contamination are shown in Table 2. In addition, because of the nuclear power plane accident by the Great East Japan Earthquake on Mar. 11, 2011, radiocontaminated grains were contained in some soils in Fukushima prefecture.

Figure 5:
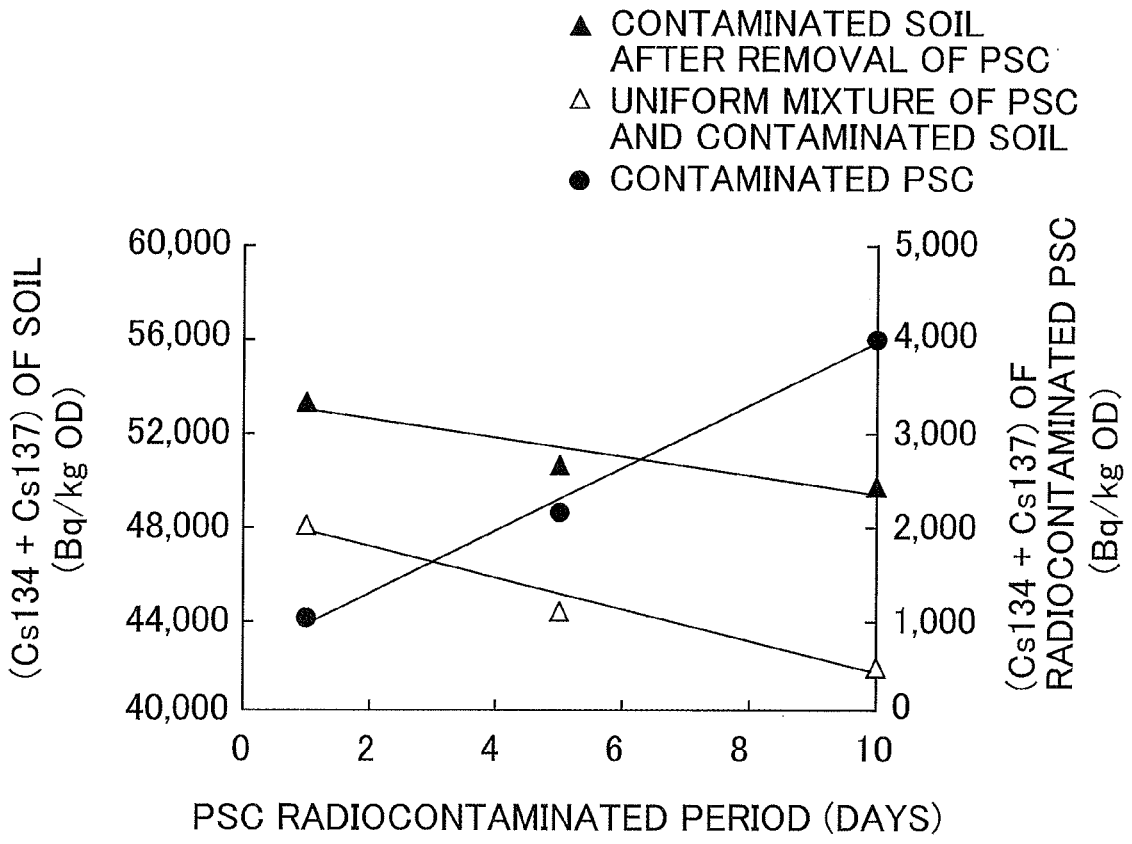
FIG. 5 is a graph showing the changes with time of a radiocontaminated soil by the decontamination method of radiocontaminated grains according to the embodiment of the present invention.

As shown in FIG. 5, as the mixture thus prepared was left for a longer time, the amount of the radioactive $^{134}Cs$ and $^{137}Cs$ contained in the radiocontaminated soil was decreased, and on the other hand, the amount of radioactive $^{134}Cs$ and $^{137}Cs$ contained in PSC was increased; hence, the radioactive cesium contained in the radiocontaminated soil can be estimated to be partially transferred to PSC.

The results obtained when the mixture described above was left for 10 days in the above laboratory test are shown in Table 1. In the test in which PSC was buried in the radiocontaminated soil, the total of the total of remaining radioactive $^{134}Cs$ and $^{137}Cs$ in the radiocontaminated soil and radioactive $^{134}Cs$ and $^{137}Cs$ adsorbed to PSC was approximately the same as the total of the radioactive $^{134}Cs$ and $^{137}Cs$ contained in the radiocontaminated soil obtained before the burying test was performed. On the other hand, in the blank test in which the radiocontaminated soil and PSC were uniformly mixed together, the total of radioactive $^{134}Cs$ and $^{137}Cs$ contained in the mixture was lower than the total of the radioactive $^{134}Cs$ and $^{137}Cs$ contained in the radiocontaminated soil obtained before the test was performed. Hence, it is found that in order to improve the decontamination degree of the radiocontaminated soil, PSC is preferably brought into contact with a large amount of the radiocontaminated soil as much as possible. Furthermore, it is also found that since the pH and the cation exchange capacity (CEC) of the radiocontaminated PSC are both decreased as compared to those of PSC before being contaminated, PSC performs an ion exchange reaction with the radioactive $^{134}Cs$ and $^{137}Cs$ contained in the radiocontaminated soil.

TABLE 1

<Analytical Result of Radiocontaminated Soil Sample and PSC>

| Item | Cs134 (Bq/kg OD) | Cs137 (Bq/kg OD) | Cs134 + Cs137 (Bq/kg OD) | pH | CEC (meq/100 g) |
|---|---|---|---|---|---|
| PSC | Not Detected | Not Detected | Not Detected | 10.5 | 2.66 |
| Radiocontaminated Soil (A) | 19,220 | 36,732 | 55,952 | 6.7 | 3.23 |
| Radiocontaminated PSC (B) | 1,405 | 2,597 | 4,002 | 8.3 | 2.55 |
| (A) After Removal of (B) | 17,010 | 32,571 | 49,581 | 6.6 | 3.30 |
| Mixture of PSC and (A) | 14,437 | 27,494 | 41,931 | 7.4 | — |

In addition to the changes described above, as shown in Table 2, the amounts of constituent elements, such as chlorine, sulfur, potassium, barium, copper, magnesium, calcium, and iron, of PSC were decreased. Hence, it is estimated that metal salt compounds of potassium, barium, copper, magnesium, calcium, iron, and the like are ion-exchanged with radioactive substances, such as the radioactive $^{134}Cs$ and $^{137}Cs$, of the radiocontaminated soil.

TABLE 2

<Composition Analytical Result of PSC before and after Radiocontaminated with Radiocontaminated Soil>

| Item | Before Radioactive Contamination PSC (1) (%) | After Radioactive Contamination PSC (2) (%) | (1)-(2) (%) |
|---|---|---|---|
| Si (as $SiO_2$) | 20.59 | 22.82 | |
| Ca (as CaO) | 12.67 | 11.46 | 9.6 |
| Al (as $Al_2O_3$) | 4.27 | 4.72 | |
| Fe (as $Fe_2O_3$) | 20.80 | 20.37 | 2.1 |
| Mg (as MgO) | 0.97 | 0.87 | 9.5 |
| Ti (as $TiO_2$) | 0.63 | 0.65 | |
| Zn (as ZnO) | 0.09 | 0.10 | |
| Cu (as CuO) | 0.0763 | 0.0688 | 9.9 |
| Mn (as $MnO_2$) | 0.0628 | 0.0649 | |
| K (as $K_2O$) | 0.0601 | 0.0516 | 14.2 |
| Cl (as $ClO_2$) | 0.1863 | 0.0399 | 78.6 |
| S (as $SO_2$) | 0.0839 | 0.0649 | 22.6 |
| Ba (as $BaO_2$) | 0.0115 | 0.0103 | 10.6 |
| C[1)] | 32.06 | 33.61 | |

[1)]Reduction Rate at 850° C. Chlorine, Sulfur, and Barium were Measured by an ICP Emission Spectral Analysis, and the Others Elements were Measured By a Flame Atomic Adsorption Method.

Based on the elemental periodic table, cesium is categorized in an alkali metal, such as sodium or potassium, and it has been known that the behavior of cesium is similar to that of the element mentioned above. On the other hand, radioactive cesium generated from a nuclear fission reaction by a nuclear power plant accident, a nuclear experiment, or the like disperses in the air and falls on soils. A soil having a negative charge attracts and holds those cesium cations. In particular, negative charges including a surface $OH^-$ of clay minerals confine fallen radioactive cesium. This is simply a physical adsorption phenomenon (http://jsspn.jp/info/secretariat/4317.html).

In this embodiment, it was found that radioactive cesium adsorbed to the soil performs ion-exchange with potassium, barium, copper, magnesium, calcium, iron, and the like, which are the constituent elements of PSC, and as a result, PSC is radiocontaminated. Hence, it is found that radioactive cesium of the radiocontaminated soil is not simply physically adsorbed to porous grain-shaped PSC.

According to the following academic literature, ion-exchange of radioactive $^{23}Na$, radioactive $^{40}Ca$, and the like with clay was experimentally confirmed. In addition, it is found that when radioactive $^{22}Na$ in clay and radioactive $^{39}Ca$ in clay are ion-exchanged with a radioactive $^{23}Na$ solution and a radioactive $^{40}Ca$ solution, respectively, the mass number of the ion element which performs ion-exchange is one point lower than the mass number of the ion element to be ion-exchanged (Ferris, A. P., Jepson, W. B., 1975. The exchange capacities of kaolinite and the preparation of homoionic clays. Journal of Colloid and Interface Science, 51(5), 245-259).

The identification, the half lives, and the like of reaction products obtained when ion-exchange is performed between radioactive $^{134}Cs$ and $^{137}Cs$ and potassium, barium, copper, magnesium, calcium, iron, and the like of the above PSC have been unknown. Furthermore, when the above stable metal performs ion-exchange with radioactive $^{134}Cs$ and $^{137}Cs$, the generation of isotopes, such as $^{64}Cu$, $^{59}Fe$, $^{65}Zn$, $^{47}Ca$, and $^{28}Mg$, has also been unknown. In addition, when isotopes of those heavy metals are generated, although transformation of radioactive $^{134}Cs$ and $^{137}Cs$ to other cesium isotopes has also been unknown, since the amount of the radioactive $^{134}Cs$ and $^{137}Cs$ in the radiocontaminated soil is decreased, the transformation is believed to occur at a high probability.

However, according to the above academic literature, it is estimated that when the radiocontaminated soil and PSC are mixed together, the radioactive $^{134}Cs$ is ion-exchanged with PSC and is estimated to be disintegrated into stable $^{133}Cs$, and as is the case described above, the radioactive $^{137}Cs$ is estimated to be disintegrated into radioactive $^{136}Cs$ having a short half life. By the estimation described above, the decrease in amount of the radioactive $^{134}Cs$ and $^{137}Cs$ contained in the radiocontaminated soil caused by the contact with PSC, which was confirmed in this embodiment, can be analyzed. Incidentally, cesium has 39 types of isotopes, and the half lives of radioactive $^{137}Cs$ and $^{134}Cs$ are 30 years and 2 years, respectively, the half lives of cesium having a mass number of 132, 135 m, 136, 138, and 138 m are 6.5 days, 53 minutes, 13.2 days, 33 minutes, and 3 minutes, respectively, and the half lives of most other isotopes are from several seconds to a fraction of a second.

According to the ion-exchange reaction between the radioactive $^{134}Cs$ and $^{137}Cs$ and potassium, barium, copper, magnesium, calcium, iron, and the like of PSC, when the amount of those metals is increased in PSC, the ion-exchange reaction is enhanced, and as a result, the decontamination degree of the radiocontaminated soil by PSC is improved. In order to confirm this assumption, at least one compound selected from the group consisting of a metal chloride, a metal sulfate, and a potassium ferrocyanide compound containing both potassium and iron was impregnated in PSC, and a decontamination effect of the radiocontaminated soil was investigated. In addition, in general, chlorine and sulfur of PSC each cannot be present by itself but each form a metal salt compound by bonding to the metal mentioned above. However, since barium sulfate and calcium sulfate are both hardly dissolved in water, experiments using those compounds were not performed.

In order to impregnate a chloride compound, a sulfate compound, or a potassium ferrocyanide compound containing both potassium and iron in PSC, in ion-exchanged water or distilled water in an amount equivalent to the weight of PSC to be used, a metal compound in an amount equivalent to 0.5% to 10% of the weight of PSC was dissolved. PSC is immersed in each of those solutions and then dried at 25° C. until a liquid is removed.

As shown below, among chloride compounds of potassium, barium, copper, magnesium, calcium, iron, and the like, potassium chloride is only usable. On the other hand, among sulfate salts of potassium, copper, magnesium, iron, and the like, potassium, copper, and magnesium can be used. Those compounds may be used alone, or not less than two sulfate compounds selected from available six combinations may be used. Furthermore, potassium ferrocyanide may also be applied. When a metal chloride, a metal sulfate, and potassium ferrocyanide are used in combination, not less than two compounds selected from available 120 combinations of those compounds may be used.

Although the content of stable cesium in PSC is very small amount, such as 0.2 ppm, in order to confirm an ion-exchange reaction between stable cesium and radioactive cesium, after 1% of cesium chloride or 1% of cesium sulfate with respect to the weight of PSC was dissolved in distilled water and was then impregnated in PSC, the PSC thus prepared was mixed with a radiocontaminated soil, and the decontamination degree was investigated.

The radiocontaminated soil used in the experiment was sampled in Iitate village, Fukushima prefecture in September, 2013 and was then air-dried to have a solid component of approximately 85%. In the following examples and reference examples, after the radiocontaminated soil (85 g, OD), PSC, a metal compound, or PSC (15 g, OD) impregnated with a potassium ferrocyanide compound was charged in a polyethylene bag in this order and was well mixed together, the mixture thus prepared was left at 25° C. for 10 days.

The radiocontaminated soil (100 g, OD) and 1% potassium chloride (percentage with respect to the soil weight) were charged in a polyethylene bag in this order. As is the case described above, the radiocontaminated soil (100 g, OD) and 1% cesium chloride (percentage with respect to the soil weight) were charged in a polyethylene bag in this order. After the contents in the polyethylene bags were each well mixed together and then left at 25° C. for 10 days, the radioactive $^{134}Cs$ and $^{137}Cs$ were measured.

TABLE 3

<Influence of each of Potassium Chloride and Cesium Chloride in Radiocontaminated Soil on Decontamination Rate>

| Item | Cs134 (Bq/kg OD) | Cs137 (Bq/kg OD) | Cs134 + Cs137 (Bq/kg OD) | Decontamination Rate (%) |
|---|---|---|---|---|
| Radiocontaminated Soil (A) | 7,905 | 20,480 | 28,385 | 0 |
| 1% KCl + (A) | 8,710 | 20,765 | 29,475 | −3.8 |
| 1% CsCl + (A) | 8,762 | 20,954 | 29,716 | −4.7 |

As shown in Table 3, when commercially available potassium chloride and cesium chloride which were not impregnated in PSC were each mixed with the radiocontaminated soil, the total of the radioactive $^{134}Cs$ and $^{137}Cs$ was increased. Although the increase in radioactive $^{137}Cs$ was small, since the increase in radioactive $^{134}Cs$ was significant, it is estimated that those chemical agents disturb the decomposition of the radioactive $^{134}Cs$.

Preparation of 6% $CaCl_2$-PSC was performed by the following procedure. $CaCl_2.2H_2O$ (23.838 g) was dissolved in distilled water (300 ml), was then poured over PSC (300 g, OD) in a shallow container, and was dried at 25° C. for 24 to 48 hours, and during this drying, the container was shook two to three times. By a method similar to that described above, KCl—PSC, $BaCl_2$—PSC, $MgCl_2$—PSC, and CsCl-PSC were formed. After the radiocontaminated soil (85 g, OD) and the above metal chloride compound-PSC (15 g, OD) were charged in a polyethylene bag in this order and were then uniformly mixed together, this mixture was left at 25° C. for 10 days. For a blank test, after the radiocontaminated soil (85 g, OD) and PSC (15 g, OD) were charged in a polyethylene bag and were then uniformly mixed together, a test was performed under the same conditions as described above. Subsequently, the radioactive $^{134}Cs$ and $^{137}Cs$ were measured. The results are shown in Table 4.

TABLE 4

<Influence of Mixture of Radiocontaminated Paddy Soil and Metal Chloride-PSC on Decontamination Rate>

| Item | Cs134 (Bq/kg OD) | CS137 (Bq/kg OD) | Cs134 + Cs137 (Bq/kg OD) | Decontamination Rate (%) |
|---|---|---|---|---|
| Radiocontaminated Soil (A) | 7,905 | 20,480 | 28,385 | — |
| (A) + PSC | 6,068 | 15,733 | 21,801 | 23.2 |
| (A) + 6% $CaCl_2$-PSC | 8,175 | 19,671 | 27,846 | 1.9 |
| (A) + 6% $MgCl_2$-PSC | 8,971 | 21,941 | 30,912 | −8.9 |
| (A) + 0.5% KCl-PSC | 5,528 | 15,905 | 21,433 | 24.5 |
| (A) + 5% KCl-PSC | 4,706 | 11,638 | 16,344 | 42.4 |
| (A) + 6% KCl-PSC | 6,208 | 14,932 | 21,140 | 25.5 |
| (A) + 6% $BaCl_2$-PSC | 7,871 | 18,830 | 26,701 | 5.9 |
| (A) + 1% $BaCl_2$-PSC | 6,681 | 16,570 | 23,251 | 18.1 |
| (A) + 1% CsCl-PSC | 6,505 | 17,281 | 23,786 | 16.2 |
| (A) + the Above Metal Chlorides-PSC* | 7,418 | 17,854 | 25,273 | 11.0 |

*1% $CaCl_2$, 1% $MgCl_2$, 1% KCl, 1% $BaCl_2$, 1% CsCl

It was found that compared to the result of the blank test, among the five types of metal chloride-PSCs thus investigated, only the potassium chloride-PSC showed a high decontamination rate. The reason for this is believed that as described above, potassium and cesium belong to the same group 1A of the elemental periodic table and are easily replaced with each other. From the above result and the result of the 1% KCl chemical reagent shown in Table 3, it is found that for the occurrence of the ion-exchange reaction, a support body is required.

Since the decontamination rates of 6% KCl—PSC and 6% $BaCl_2$—PSC were low as compared to those of 5% KCl—PSC and 1% $BaCl_2$—PSC, respectively, it is found that a chlorine group retards the decontamination reaction. On the other hand, since the decontamination rate of each of 6% $CaCl_2$—PSC, 1% $BaCl_2$—PSC, 6% $MgCl_2$—PSC, and 5% CsCl—PSC was inferior to that of the blank test, it is found that when the concentrations of calcium, barium, magnesium, and cesium are high, the decontamination reaction is disturbed.

Preparation of 1% $MgSO_4$—PSC was performed by the following method. Magnesium sulfate ($MgSO_4$, 3 g) was dissolved in distilled water (300 ml), was then poured over PSC (300 g, OD) in a shallow container, and was dried at 25° C. for 24 to 48 hours, and during this drying, the container was shook two to three times. By a method similar to that described above, $K_2SO_4$—PSC, $FeSO_4$—PSC, $ZnSO_4$—PSC, $CuSO_4$—PSC, and $CsSO_4$—PSC were formed using potassium sulfate, $FeSO_4.7H_2O$, $ZnSO_4.7H_2O$, $CuSO_4.5H_2O$, and cesium sulfate, respectively. After the radiocontaminated soil (85 g, OD) and the metal sulfate-PSC (15 g, OD) were charged in a polyethylene bag in this order and were then uniformly mixed together, this mixture was left at 25° C. for 10 days. For a blank test, after the radiocontaminated soil (85 g, OD) and PSC (15 g, Od) were charged in a polyethylene bag and were then uniformly mixed together, a test was performed under the same conditions as described above. Subsequently, the radioactive $^{134}Cs$ and $^{137}Cs$ were measured. The results are shown in Table 5.

TABLE 5

<Influence of Mixture of Radiocontaminated Paddy Soil and Metal Sulfate-PSC on Decontamination Rate>

| Item | Cs134 (Bq/kg OD) | CS137 (Bq/kg OD) | Cs134 + Cs137 (Bq/kg OD) | Decontamination Rate (%) |
|---|---|---|---|---|
| Radiocontaminated Soil (A) | 7,905 | 20,480 | 28,385 | — |
| (A) + PSC | 6,068 | 15,733 | 21,801 | 23.2 |
| (A) + 1% $MgSO_4$-PSC | 5,179 | 12,932 | 18,311 | 36.2 |
| (A) + 5% $MgSO_4$-PSC | 5,583 | 15,993 | 21,576 | 24.0 |
| (A) + 0.5% $K_2SO_4$-PSC | 5,674 | 16,342 | 22,016 | 22.4 |
| (A) + 5% $K_2SO_4$-PSC | 5,712 | 14,109 | 19,821 | 30.2 |
| (A) + 1% $FeSO_4$-PSC | 5,990 | 16,034 | 22,024 | 22.4 |
| (A) + 1% $ZnSO_4$-PSC | 5,842 | 15,724 | 21,565 | 24.0 |
| (A) + 0.5% $CuSO_4$-PSC | 6,962 | 16,841 | 23,803 | 16.1 |
| (A) + 1% $CuSO_4$-PSC | 5,203 | 12,845 | 18,048 | 36.4 |
| (A) + 5% $CuSO_4$-PSC | 5,665 | 16,351 | 22,016 | 22.4 |
| (A) + 1% $Cs_2SO_4$-PSC | 6,605 | 17,892 | 24,497 | 13.7 |
| (A) + 1% $CuSO_4$-PSC + 5% KCl-PSC | 4,430 | 11,935 | 16,365 | 42.3 |

Compared to the result of the blank test, among the six types of metal sulfate-PSCs thus investigated, the cesium sulfate only showed an inferior decontamination rate. From the above result and the result of the decontamination rate of the cesium chloride shown in Table 4, it is found that the stable cesium disturbs the decontamination reaction of radioactive cesium. Since the decontamination rates of iron sulfate and zinc sulfate are each approximately equivalent to that of the blank test, those metal sulfates are not required to be impregnated in PSC. On the other hand, since magnesium sulfate, copper sulfate, and potassium sulfate each show a superior decontamination rate to that of the blank test, when those metal sulfates are each impregnated in PSC, the decontamination rate of the radiocontaminated soil can be improved.

Preparation of 1% potassium ferrocyanide-PSC was performed by the following method. $K_4[Fe(CN)_6]3H_2O$ (3.385 g) was dissolved in distilled water (360 ml), was then poured over PSC (300 g, OD) in a shallow container, and was dried at 25° C. for 24 to 48 hours, and during this drying, the container was shook two to three times. After the radiocontaminated soil (85 g, OD) and the potassium ferrocyanide-PSC (15 g, OD) were charged in a polyethylene bag in this order and were then uniformly mixed together, this mixture was left at 25° C. for 10 days. For a blank test, after the radiocontaminated soil (85 g, OD) and PSC (15 g, OD) were charged in a polyethylene bag and were then uniformly mixed together, a test was performed under the same conditions as described above. Subsequently, the radioactive $^{134}Cs$ and $^{137}Cs$ were measured. The results are shown in Table 6.

TABLE 6

<Influence of Mixture of Radiocontaminated Paddy Soil and Potassium Ferrocyanide (Potassium Hexacyanoferrate (II) Trihydrate)-PSC on Decontamination Rate>

| Item | Cs134 (Bq/kg OD) | Cs137 (Bq/kg OD) | Cs134 + Cs137 (Bq/kg OD) | Decontamination Rate (%) |
|---|---|---|---|---|
| Radiocontaminated Soil (A) | 7,905 | 20,480 | 28,385 | — |
| (A) + PSC | 6,068 | 15,733 | 21,801 | 23.2 |
| (A) + 0.5% Potassium Ferrocyanide-PSC | 5,416 | 15,760 | 21,176 | 25.4 |
| (A) + 1% Potassium Ferrocyanide-PSC | 4,876 | 14,069 | 18,945 | 33.3 |
| (A) + 5% Potassium Ferrocyanide-PSC | 5,115 | 15,014 | 20,129 | 29.1 |

It was found that the potassium ferrocyanide-PSC showed a high decontamination rate as compared to that of the blank test. The reason for this is believed that potassium, iron, and the like, each of which performs ion-exchange with radioactive cesium as described above, are both present in potassium ferrocyanide. Hence, when potassium ferrocyanide is impregnated in PSC, the decontamination rate of the radiocontaminated soil can be improved.

When the results shown in Tables 4, 5, and 6 are taken into consideration, in order to improve the decontamination rate of the radiocontaminated soil, a chloride compound of potassium, a sulfate salt of magnesium, a sulfate salt of potassium, a sulfate salt of copper, and/or a potassium ferrocyanide compound should be impregnated in PSC. In addition, in order to obtain a synergetic effect of the decontamination rate of the radiocontaminated soil, among available 120 combinations (since five types are present, the number of combinations thereof is 120 by 1×2×3×4×5) of potassium chloride, magnesium sulfate, potassium sulfate, copper sulfate, and potassium ferrocyanide, not less than two compounds should be impregnated in PSC.

When PSC impregnated with no less than two compounds selected from the available 120 combinations of potassium chloride, magnesium sulfate, potassium sulfate, copper sulfate, and potassium ferrocyanide described above is mixed with the radiocontaminated grains processed by a pretreatment using a sodium phosphate-based dispersant, the decontamination rate of the radioactive $^{134}Cs$ and $^{137}Cs$ can be improved.

Although the embodiment of the present invention has thus been described in detail, the present invention is not limited to the above embodiment. In addition, the present invention may be variously changed and/or modified without departing from the scope described in the claims.

The invention claimed is:

1. A method for decontaminating radiocontaminated grains, the method comprising: a pretreatment step of mixing radiocontaminated grains and a sodium phosphate-based dispersant; and a decontamination step of mixing the radiocontaminated grains processed by the pre-treatment step and paper sludge-derived sintered carbonized porous grains so as to incorporate radioactive $^{134}Cs$ and $^{137}Cs$ of the radiocontaminated grains in the sintered carbonized porous grains.

2. The method for decontaminating radiocontaminated grains according to claim 1, wherein the sodium phosphate-based dispersant contains at least one compound selected from the group consisting of sodium hexametaphosphate, sodium tripolyphosphate, and sodium tetrapyrophosphate.

3. The method for decontaminating radiocontaminated grains according to claim 1, wherein at least one ion-exchangeable compound selected from the group consisting of potassium chloride, magnesium sulfate, and copper sulfate is impregnated in the sintered carbonized porous grains, these sintered carbonized porous grains and the radiocontaminated grains processed by the pre-treatment step are mixed together, and the radioactive $^{134}Cs$ and $^{137}Cs$ of the radiocontaminated grains are incorporated in the sintered carbonized porous grains by ion-exchange.

4. The method for decontaminating radiocontaminated grains according to claim 2, wherein at least one ion-exchangeable compound selected from the group consisting of potassium chloride, magnesium sulfate, and copper sulfate is impregnated in the sintered carbonized porous grains, these sintered carbonized porous grains and the radiocontaminated grains processed by the pre-treatment step are mixed together, and the radioactive $^{134}Cs$ and $^{137}Cs$ of the radiocontaminated grains are incorporated in the sintered carbonized porous grains by ion-exchange.

5. The method for decontaminating radiocontaminated grains according to claim 2, wherein the sodium phosphate-based dispersant contains sodium hexametaphosphate.

6. The method for decontaminating radiocontaminated grains according to claim 2, wherein the sodium phosphate-based dispersant contains sodium tripolyphosphate.

7. The method for decontaminating radiocontaminated grains according to claim 2, wherein the sodium phosphate-based dispersant contains sodium tetrapyrophosphate.

8. The method for decontaminating radiocontaminated grains according to claim 3, wherein potassium chloride is impregnated in the sintered carbonized porous grains.

9. The method for decontaminating radiocontaminated grains according to claim 3, wherein magnesium sulfate is impregnated in the sintered carbonized porous grains.

10. The method for decontaminating radiocontaminated grains according to claim 3, wherein copper sulfate is impregnated in the sintered carbonized porous grains.

11. The method for decontaminating radiocontaminated grains according to claim 4, wherein potassium chloride is impregnated in the sintered carbonized porous grains.

12. The method for decontaminating radiocontaminated grains according to claim 4, wherein magnesium sulfate is impregnated in the sintered carbonized porous grains.

13. The method for decontaminating radiocontaminated grains according to claim 4, wherein copper sulfate is impregnated in the sintered carbonized porous grains.

* * * * *